US009306354B2

(12) United States Patent
Petermann et al.

(10) Patent No.: US 9,306,354 B2
(45) Date of Patent: Apr. 5, 2016

(54) DEVICES FOR AUTOMATED PRODUCTION OF A PLUG FROM A PLUG HOUSING AND ELONGATE CONTACTS

(71) Applicant: Schleuniger Holding AG, Thun (CH)

(72) Inventors: Manfred Petermann, Buchrain (CH); Carmelo Messina, Baar (CH); Walter Knuchel, Gruet (CH)

(73) Assignee: Schleuniger Holding AG, Thun (CH)

( * ) Notice: Subject to any disclaimer, the term of this patent is extended or adjusted under 35 U.S.C. 154(b) by 94 days.

(21) Appl. No.: 13/865,419

(22) Filed: Apr. 18, 2013

(65) Prior Publication Data

US 2014/0007427 A1 Jan. 9, 2014

Related U.S. Application Data

(60) Provisional application No. 61/636,345, filed on Apr. 20, 2012.

(30) Foreign Application Priority Data

Apr. 20, 2012 (EP) ..... 12164968

(51) Int. Cl.
*H01R 43/20* (2006.01)
*H01R 43/00* (2006.01)
*H01R 43/16* (2006.01)

(52) U.S. Cl.
CPC ..... *H01R 43/00* (2013.01); *H01R 43/16* (2013.01); *H01R 43/20* (2013.01); *Y10T 29/49222* (2015.01); *Y10T 29/53209* (2015.01)

(58) Field of Classification Search
CPC ..... H01R 43/16
USPC ..... 29/748, 759, 33 M, 874, 882, 754; 439/80, 582, 742
See application file for complete search history.

(56) References Cited

U.S. PATENT DOCUMENTS 3,864,000 A 2/1975 Coller et al.
4,849,743 A 7/1989 Ohno (Continued)

FOREIGN PATENT DOCUMENTS

DE 2802991 A1 7/1978
DE 4010349 A1 10/1991

(Continued)

OTHER PUBLICATIONS

EPO search reports and written opinions (two) from priority EPO application EP12164968, dated Mar. 28, 2013, and Nov. 15, 2012.

*Primary Examiner* — Minh Trinh
(74) *Attorney, Agent, or Firm* — Matthew B. Dernier, Esq.

(57) ABSTRACT

The invention relates to a method for fabricating a plug (18) formed from a plug housing (19) and elongate contacts (3), the contacts (3) comprising a bent longitudinal axis (23) inside the finished plug (18), characterized by:

Figure 1:
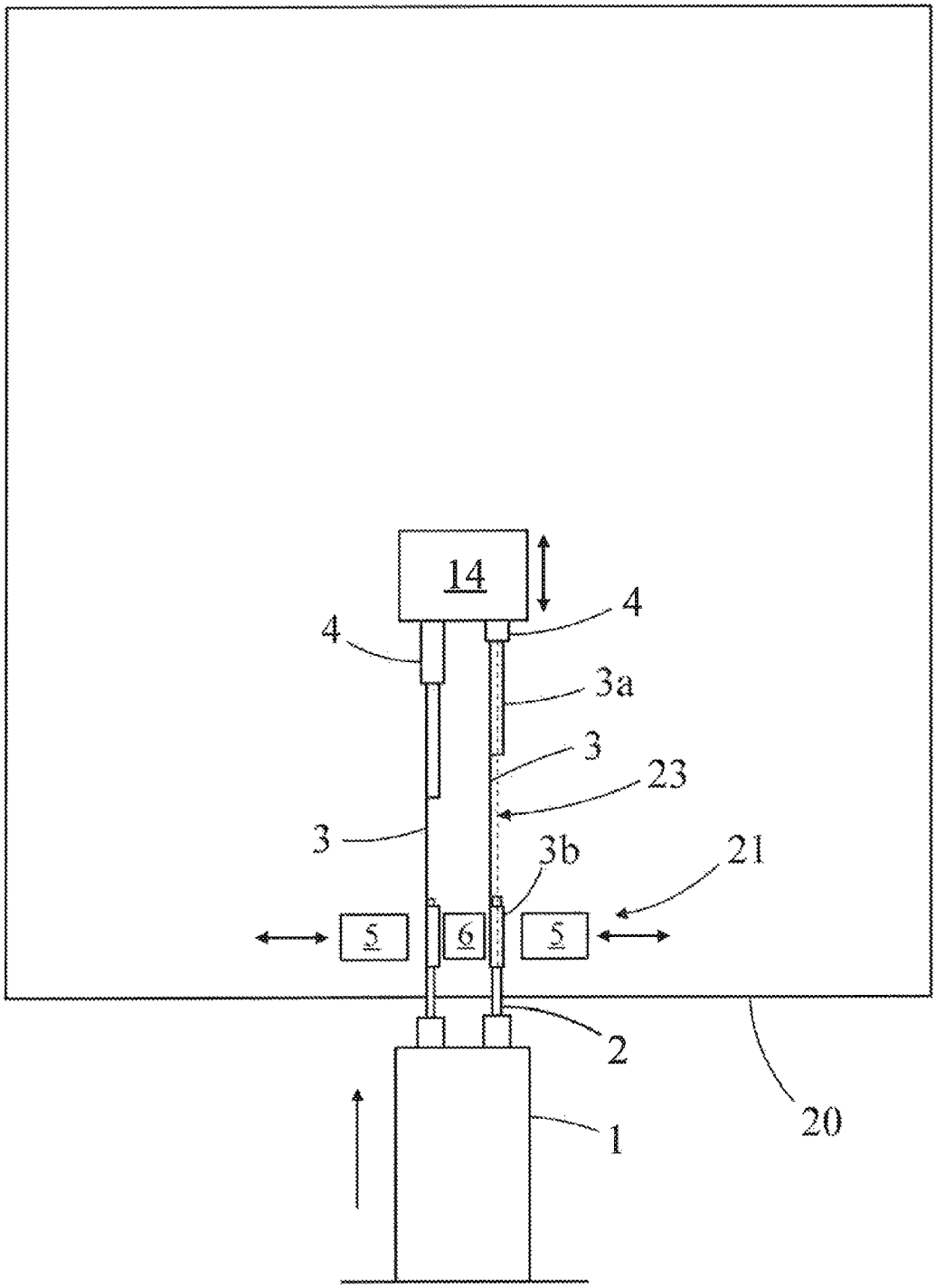

introducing front portions (3*a*) of the contacts (3) into contact receptacles (17) of a plug housing part (7);

holding the plug housing part (7) by means of a first holding arrangement (15) of a plug fabrication device (20);

holding rear portions (3*b*) of the contacts (3) by means of a second holding arrangement (21) of the plug fabrication device (20);

pivoting the first holding arrangement (15) with the plug housing part (7) held thereby relative to the second holding arrangement (21) with the contacts (3) held thereby, whereby the longitudinal axis (23) of the contacts (3) is bent in the region between their front portions (3*a*) and their rear portions (3*b*).

4 Claims, 8 Drawing Sheets

(56) References Cited

U.S. PATENT DOCUMENTS

| | | | | |
|---|---|---|---|---|
| 5,187,862 | A * | 2/1993 | Ohsumi | 29/764 |
| 5,315,756 | A | 5/1994 | Jurjevic et al. | |
| 5,414,925 | A | 5/1995 | Nishide et al. | |
| 5,466,174 | A | 11/1995 | Savage | |
| 5,504,990 | A * | 4/1996 | Pittau | 29/748 |
| 6,017,224 | A | 1/2000 | Yanagida | |
| 6,302,711 | B1 | 10/2001 | Ito | |
| 6,332,814 | B2 | 12/2001 | Sato et al. | |
| 6,817,899 | B1 | 11/2004 | Zerebilov | |
| 7,124,506 | B2 | 10/2006 | Yamanashi et al. | |

FOREIGN PATENT DOCUMENTS

| | | | |
|---|---|---|---|
| DE | 102010039314 | A1 | 2/2012 |
| GB | 1585201 | A | 2/1981 |
| JP | H08-195240 | A | 7/1996 |
| JP | 2000-077152 | A | 3/2000 |
| JP | 2000-311761 | A | 11/2000 |
| JP | 2007-287474 | A | 11/2007 |
| JP | 2007-287539 | A | 11/2007 |

* cited by examiner

DEVICES FOR AUTOMATED PRODUCTION OF A PLUG FROM A PLUG HOUSING AND ELONGATE CONTACTS

The invention relates to a method for producing a plug and to a plug fabrication device according to the embodiments disclosed and described herein.

On the market, there is a high demand for plugs of which the plug contacts are inclined by approximately 90° based on the cable exiting from the plug. The production of plugs of this type is associated with difficulties however.

The introduction into a plug housing of elongate contacts having a longitudinal axis bent through 90° for example is a complex and time-consuming process. This process is additionally hindered if the contacts are already fastened to the line ends of a cable in the form of crimp contacts. It has not previously been possible to achieve reliable automation with reproducible results.

U.S. Pat. No. 6,332,814 B2 discloses plugs in which crimp contacts are inserted from behind into a plug housing. As can be seen from FIG. 6, a protrusion in the front region of a crimp contact is bent over using a bending tool that reaches the interior of the housing through an access opening. In this case, the bend is made transverse to the longitudinal axis of the crimp contact. The purpose of this method is to fix the crimp contact inside the housing and to prevent it from being pulled out. This document does not concern the type of 90° plugs mentioned in the introduction.

U.S. Pat. No. 6,017,224 A discloses a plug housing, into which a contact is introduced. The contact is bent by a linearly movable tool when parts of the contact are housed in the housing. The difficulty of automating such a process lies in the fact that the contact is slid from one side into the housing and is bent from the other side of the housing. Production of a plug of this type on a prefabricated cable is not possible.

In U.S. Pat. No. 7,124,506 B2, a contact is slid into a housing and is clamped therein.

JP-8-195240 A discloses a method for fastening crimp contacts in the plug housing to the lines. Here, the crimp contacts are placed in the housing before the crimping process.

The fabrication of plugs that accommodate bent contacts is hindered by the fact that the contacts and the housing are generally very small. Crimping of pre-bent contacts onto the cores of a cable and only then introducing them into the plug housing is very complex and can only be achieved in automated form with enormous outlay.

The object of the invention is to produce a plug having elongate, yet bent contacts in a simple, cost-effective and reproducible manner. The solution is to be characterised by process reliability, accuracy and high productivity.

This object is achieved by a method according to the preamble of Claim 1, which is characterised by:

introducing front portions of the contacts into contact receptacles of a plug housing part;

holding the plug housing part by means of a first holding arrangement of a plug fabrication device;

holding rear portions of the contacts by means of a second holding arrangement of the plug fabrication device;

pivoting the first holding arrangement with the plug housing part held thereby relative to the second holding arrangement with the contacts held thereby, whereby the longitudinal axis of the contacts is bent in the region between their front portions and their rear portions.

In accordance with the invention, the elongate electrical contacts, which initially have a straight longitudinal axis, are introduced via their front portions into a common plug housing part and are only then bent.

This occurs in an automated plug fabrication device comprising a holding arrangement for the plug housing part and a holding arrangement for the rear portions of the contacts. The holding arrangements can cooperate in an interlocked and/or force-locked manner with the parts held thereby. Of course, it is possible and preferable if the plug housing part and rear contact portions are already held by the holding arrangement during the introduction of front contact portions into the contact receptacles of the plug housing part.

The holding arrangements are pivotable relative to one another. In a preferred embodiment, the second holding arrangement remains stationary during the relative pivoting motion and the first holding arrangement is moved. Alternatively, the first holding arrangement can also remain stationary and the second holding arrangement is moved, or both holding arrangements are moved. The pivoting motion is performed preferably about a pivot spindle, on which one of the two holding arrangement is pivotably mounted. The relative pivoting could also include a translatory movement component however.

The plug housing part comprises contact receptacles for receiving or holding the front portions of the contacts. When the holding arrangements are pivoted relatively, the contacts remain secured or fixed in or through the contact receptacles of the plug housing part.

The contact receptacles are preferably elongate receptacles matched to the shape of the front portions of the contacts and arranged parallel to one another. They each form an elongate through-hole, such that the front portions of the contacts can simultaneously form the plug contacts of the finished plug.

The rear portion of a contact is any portion that is designed to be attached to an electrical line. The contacts are preferably crimp contacts, of which the rear portions form crimp connections. A reliable electrical and mechanical connection to the lines of a cable can thus be produced. In addition, elongate crimp contacts of any shape and size are available on the market and can be produced cost effectively.

With the present solution, the contacts are introduced into the plug housing part when they are still straight, which is significantly easier and more process-reliable. The plug housing part is used as an auxiliary tool in cooperation with the first holding arrangement.

A significant advantage of the invention lies in the fact that the contacts associated with a plug cannot be bent individually, but jointly and at the same time in one process step.

The front portions of the contacts preferably form plug contacts of the plug to be fabricated. The front portions of the contacts can be formed as a female plug contact, in particular as a sleeve, or as a male plug contact, in particular as a pin. The plug housing part from which the fabricated plug housing is formed may therefore be formed fully from non-conductive material, in particular plastic.

The contacts are preferably each fastened already via their rear portions to electrical lines of a cable before introduction of their front portions into contact receptacles of the plug housing part. In so doing, the plug is fabricated directly on a prepared cable. The end product is a finished plug that is already connected to a cable. By means of the cable, the contacts attached to the end thereof can be introduced much more easily into the plug fabrication device, where they are then positioned. The crimping process for fastening the contacts to the lines of the cable can therefore be carried out already in a preceding process step, without interference by the plug housing.

Whilst the front portions of the contacts are introduced into contact receptacles of the plug housing part, the plug housing part is preferably held by the first holding arrangement, the contacts are held by the second holding arrangement, and the first holding arrangement and the second holding arrangement are moved relatively towards one another. The holding arrangements are advantageously not only used to bend the contacts, but also beforehand to introduce the front portions into the plug housing part.

The front portions of the contacts are preferably introduced into contact receptacles of the plug housing part by a movement of the plug housing part relative to the contacts in a direction parallel to the longitudinal axis of the contacts, which are initially still straight. All contacts to be housed in the plug housing can thus be introduced into the plug housing part in a single translatory movement process.

The plug housing part preferably comprises at least one wing, which is folded after the relative pivoting of the holding arrangements so as to form a closed plug housing, the wing preferably having a shaping matched to the contour of the bent contact. The wing formed integrally on the plug housing part is initially still in the unfolded state so as not to hinder the bending process and the tools possibly necessary for this purpose. Only once the contacts have been bent is the at least one wing folded so as to cover the remaining portions of the contacts and therefore form a closed plug housing. The plug housing part preferably comprises two wings protruding in opposite directions, said wings being folded towards one another.

The first holding arrangement preferably comprises a gripper, which can adopt an open position and a gripping position. The plug housing part is therefore fixed reliably.

The second holding arrangement preferably comprises clamp parts movable relative to one another. The rear portions of the contacts can thus be firmly fixed during the bending process.

The contacts are preferably oriented substantially parallel to one another before their front portions are introduced into the contact receptacles, the parallel orientation preferably being achieved with the aid of the second holding arrangement. The parallel orientation facilitates the introduction of the contacts, which are still straight, into the contact receptacles of the plug housing part.

During the introduction of their front ends into the contact receptacles, contacts that are closer to a bending axis defined by the bending process preferably reach less far into the contact receptacles than contacts that are further away from the bending axis, wherein this is preferably achieved as a result of the fact that the contacts have different lengths. Due to this measure, different bend radii are compensated for, and therefore the front portions of all contacts are fully in the contact receptacles in the finished plug.

The contacts are preferably positioned with the aid of a positioning tool before they are held by the second holding arrangement, the positioning tool preferably comprising stops, against which the front portions of the contacts are applied in the correct position for further processing, the stops preferably being formed as stop sensors. A position correct for further processing can therefore be achieved. In the embodiment as stop sensors, the stops can detect when the desired position for each individual contact has been reached. As soon as all contacts are in the correct position, the second holding arrangement can be actuated via a control device so as to fix the contacts in the desired position.

All contacts (for example four in number) are detected in their position by the sensors and are clamped individually by the holding arrangement as soon as they are in the correct position.

The pivoting is preferably carried out in such a way that the longitudinal axis of the contacts in the finished plug is bent by at least 30°, preferably by at least 45°, particularly preferably by approximately 90°. In other words, the rear portion is inclined with respect to the front portion of a contact by at least 30°, preferably by at least 45°, particularly preferably by approximately 90°. 90° plugs are particularly preferred and are currently used most frequently, although other angles are also possible in principle. For example, 60° is possible to name just one example.

The object is also achieved with a plug fabrication device for fabricating a plug formed of a plug housing and elongate contacts, the contacts inside the finished plug having a bent longitudinal axis, the plug fabrication device being characterised by:

a first holding arrangement for holding a plug housing part having contact receptacles, into which front portions of the contacts can be introduced;

and a second holding arrangement for holding rear portions of the contacts;

the first holding arrangement and the second holding arrangement being pivotable relative to one another, such that the longitudinal axis of the contacts bends in the region between their front portions and their rear portions.

A plug fabrication device of this type enables automated fabrication of plugs.

The first holding arrangement and the second holding arrangement are preferably pivotable relative to one another by at least 30°, preferably by at least 45°, particularly preferably by at least 90°.

The first holding arrangement and the second holding arrangement are preferably movable relatively towards one another in order to introduce front portions of the contacts into the contact receptacles of the plug housing part. A movement in translation is thus sufficient in order to introduce the contacts via their front portions into the plug housing part.

The first holding arrangement preferably comprises a gripper, which can adopt an open position and a gripping position, and/or the second holding arrangement comprises clamp parts movable relative to one another.

The plug fabrication device preferably comprises a positioning tool movable relative to the second holding arrangement in order to position the contacts in the second holding arrangement, the positioning tool preferably comprising stops for the front portions of the contacts, and the stops preferably being formed as stop sensors.

At least one stop of the positioning tool is preferably set back relative to another stop of the positioning tool. Different bend radii can thus be compensated for by an initial set-back positioning of one or more contacts.

The plug fabrication device preferably comprises a folding tool for folding a wing of a plug housing part after the relative pivoting of the holding arrangements in order to form a closed plug housing. The subsequent finishing of the plug housing can thus also be performed in an automated manner. For this purpose, the folding tool comprises a driver, which presses the wing into is folded position.

For definition of a bending line between the front portions and the rear portions of the contacts, the plug fabrication device preferably comprises at least one die, which is movable into the bending region. A bending line is to be understood to mean the bent contour of the contacts after the bending process. The bending process is thus even more reliable.

The plug fabrication device preferably comprises a centring device in order to centre the contacts with respect to the plug housing part.

In a further preferred embodiment, the plug fabrication device comprises at least one first slide, which, after the bending process is movable axially toward the front portions of the contacts and, as a result of this movement, presses the front portion of at least one contact fully into the plug housing part, wherein the first slide preferably has a contour adapted to the bend radius of the contact.

In a further preferred embodiment, the plug fabrication device comprises at least one second slide, which, after the bending process, is movable axially towards the rear portions of the contacts and, as a result of this movement, fixes the front portion of at least one contact, preferably on a collar formed on the contact.

The following description presents a preferred fabrication sequence:

The plug housing part is inserted into the cavity of a holding arrangement. The holding arrangement with the plug housing part is moved into the clamping position. The cable is inserted with the contacts into the plug housing part. The contacts are centred by a centring arrangement and are then clamped. During the bending process, the holding arrangements are pivoted relative to one another.

In order to reach the end position at 90°, an overbend of more than 90° for example is first preferably carried out in order to compensate for relaxation, and a return into the end position of 90° is then carried out.

In a preferred embodiment, rotation to an angle value of less than 90° is initially again carried out after the overbend. Only then is the 90° end position then reached. It has been found that the smaller of the two radii thus adopts a more precise 90° bend, whereas the longer of the two contacts remains uninfluenced by this counter movement. This procedure can of course be applied similarly in conjunction with other angle values.

The contacts, for example two long and two short contacts, wherein the latter are arranged closer to the bend axis, are guided and bent in the plug housing part.

The centring arrangement is opened and the second holding arrangement is slid away from the working region so as to create space for the folding arrangement. The latter is brought into position and uses a left and right driver, which are formed as pivot arms, to close the wings of the plug housing part to form a closed plug housing.

The folding arrangement is then moved from the working region, and the cable fitted with a plug can be removed from the plug fabrication device.

By way of example, a four-wire cable is processed, to which the four contacts having two different lengths are crimped. However, any number of contacts can be produced in accordance with the invention in a common housing.

The features of a particularly preferred embodiment lie in:

introducing at least two elongate crimp contacts via their front portions into elongate contact receptacles of a common plug housing, wherein the crimp contacts are already fastened via their rear portions to ends of lines that are combined in a common cable;

bending the crimp contacts in the region between the front portion and the rear portion so that the rear portions of the crimp contact adjoining a line are inclined, preferably by approximately 90°, relative to the longitudinal axis of the contact receptacles, into which the front portions are inserted. (Here, the bending axis runs transverse to the longitudinal extent of the crimp contact).

Advantageous developments are presented in the figures and in the dependent claims.

Further advantages, features and details of the invention will emerge from the following description, in which exemplary embodiments of the invention are described with reference to the drawings. Here, the features mentioned in the claims and in the description may be essential to the invention either individually per se or in any combination.

The list of reference signs forms part of the disclosure. The figures will be described coherently and comprehensively. Like reference signs denote like components, and reference signs having different indices specify functionally like or similar components.

Figure 2:
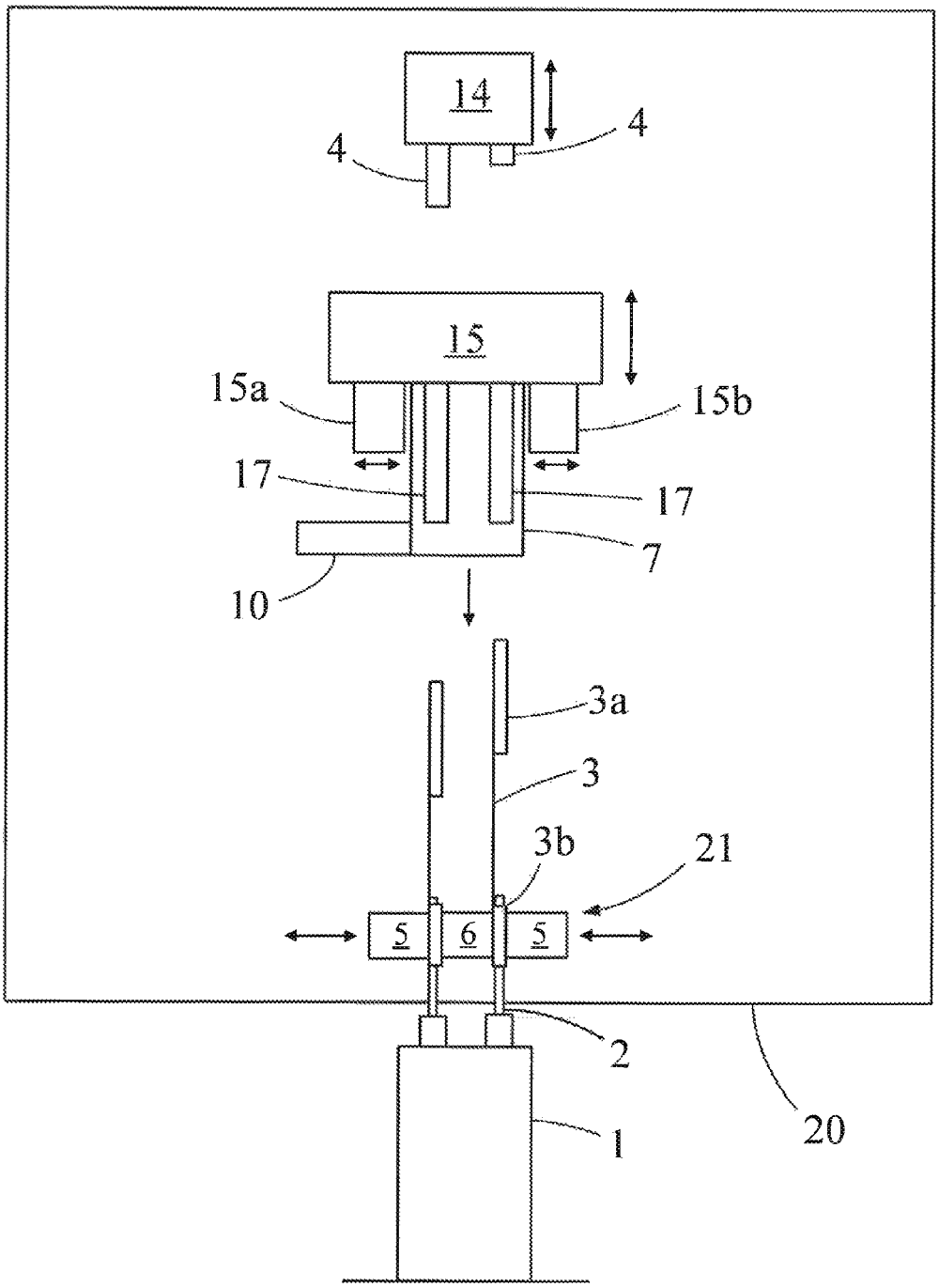
Figure 3:
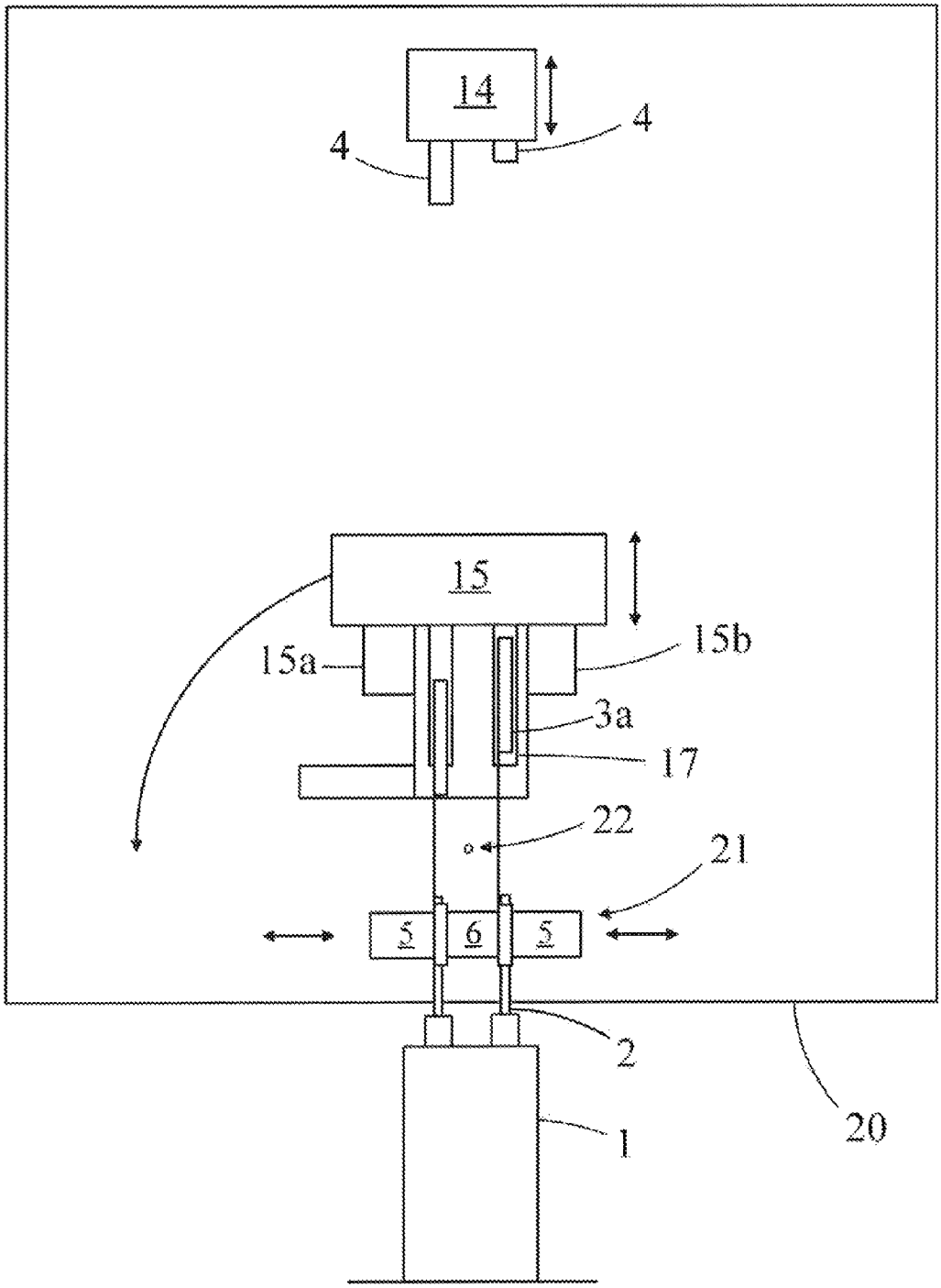
Figure 4:
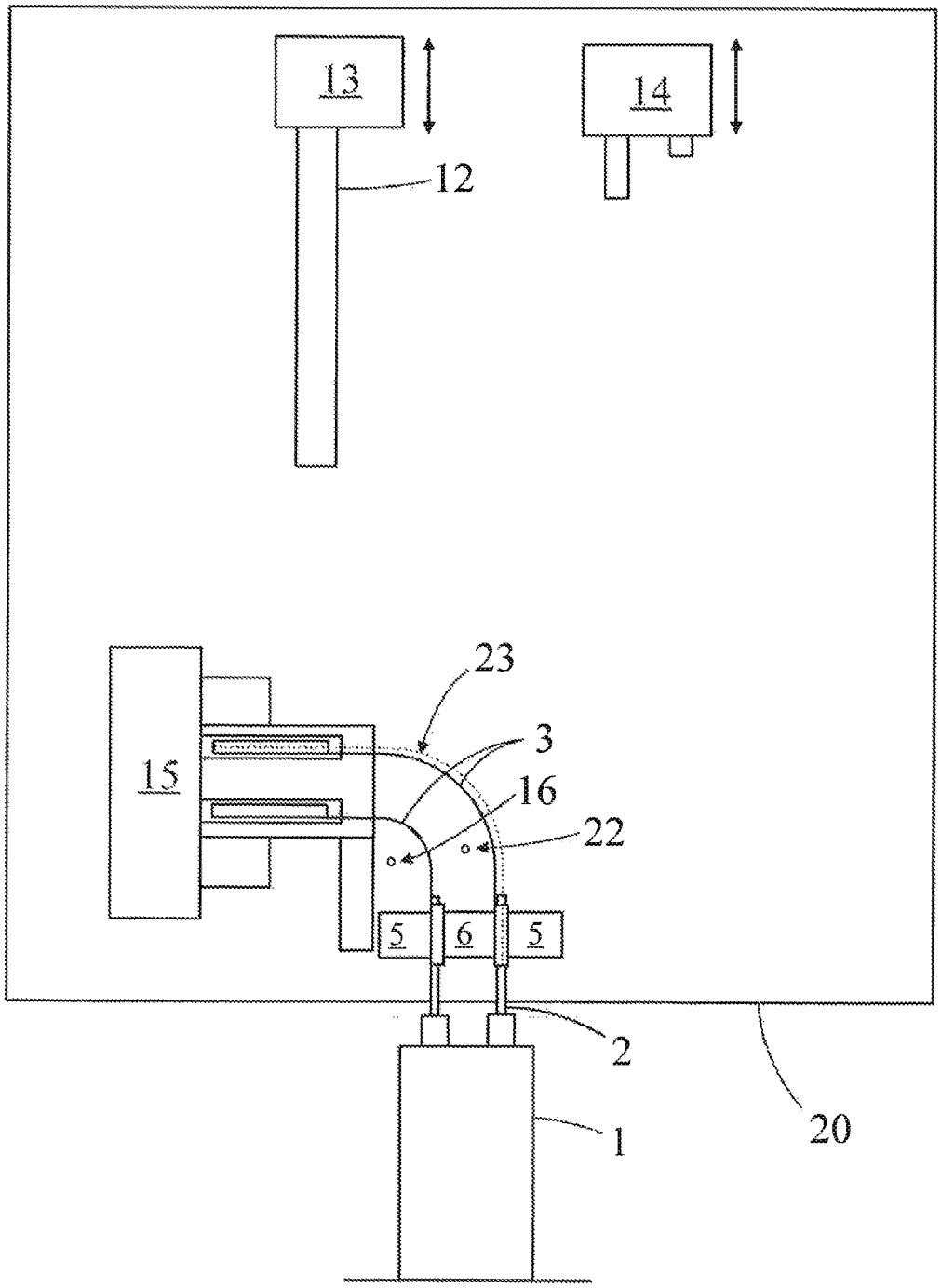
Figure 5:
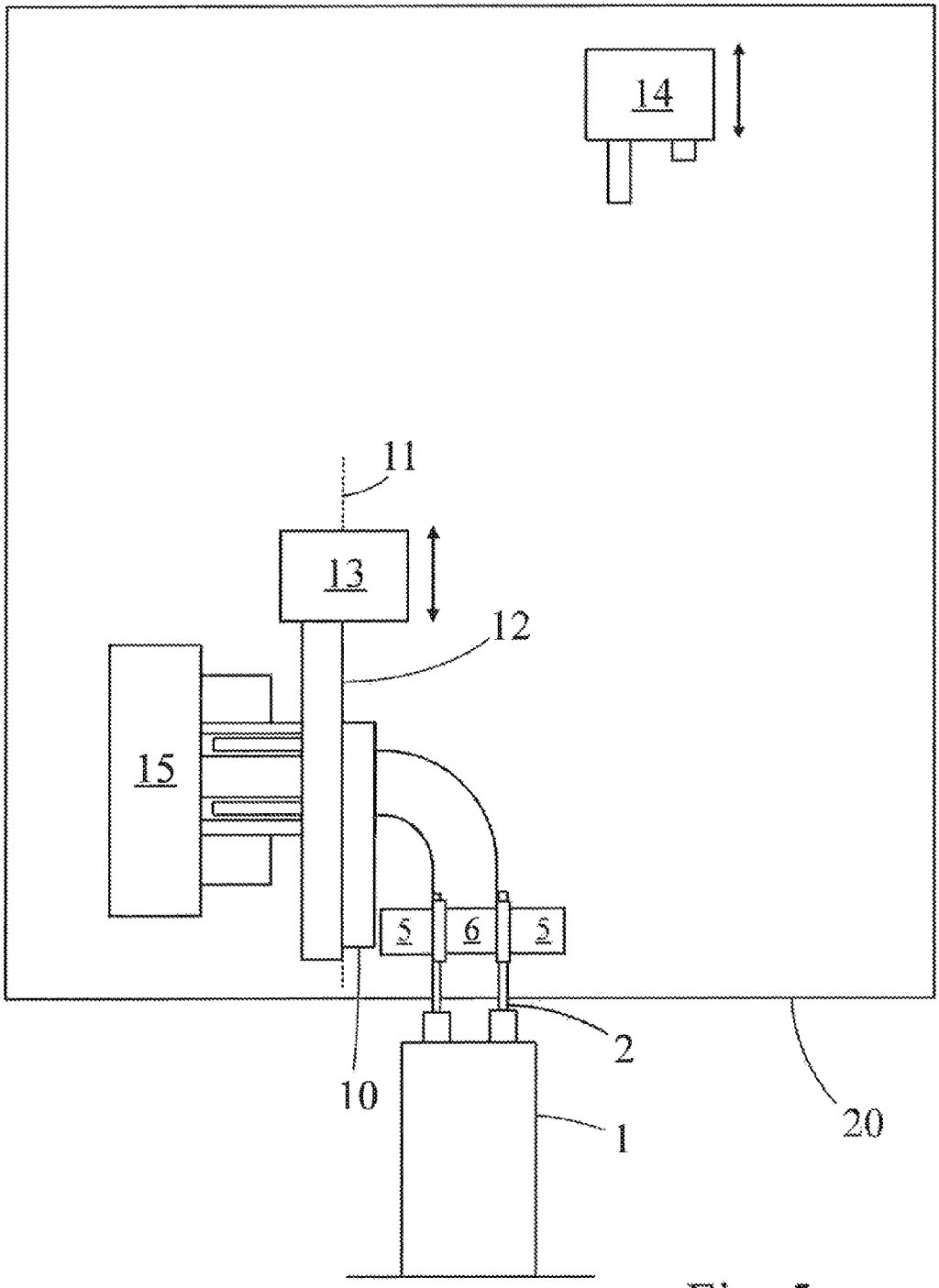
Figure 6:
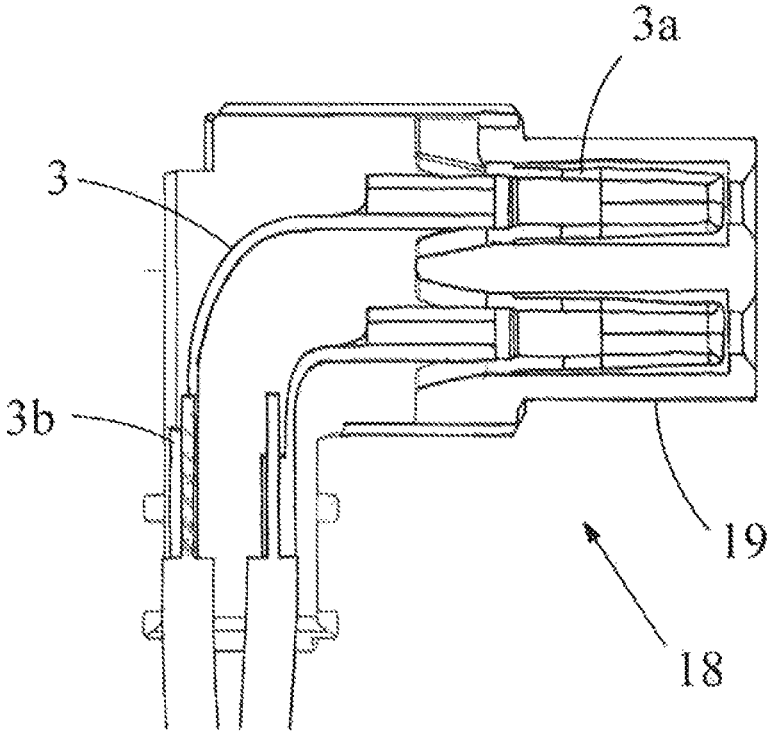
Figure 7:
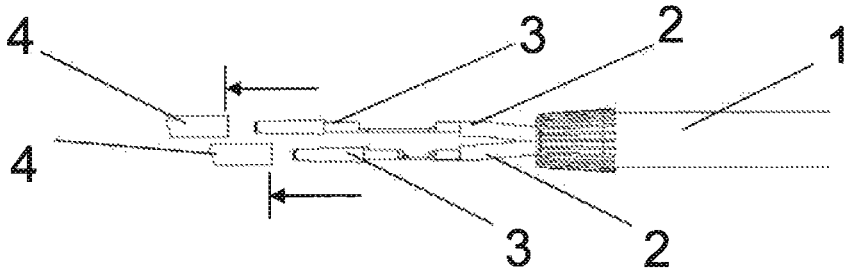

In the drawings:

FIG. 1 shows a plug fabrication device according to the invention when positioning the contacts, FIG. 2 shows the device from FIG. 1 with the holding arrangement for the plug housing part, FIG. 3 shows the device from FIG. 2 when introducing the contacts into the contact receptacles of the plug housing, FIG. 4 shows the device from FIG. 3 after the relative pivoting of the holding devices, FIG. 5 shows the device from FIG. 4 when folding a wing of the plug housing part by means of a folding tool, FIG. 6 shows a section through a finished plug, and FIGS. 7 to 16 show the individual steps of the plug fabrication in detail.

FIG. 1 shows a plug fabrication device 20, which comprises a positioning tool 14 for the positioning of elongate contacts 3. The elongate contacts 3 are crimp contacts in the illustrated exemplary embodiment and are each fastened on the end of an electrical line 2 (or core) of a cable 1. The contacts 3 each have a front portion 3*a* and a rear portion 3*b*. In the illustrated preferred embodiment, the region between the portions 3*a*, 3*b* is thinner than the adjoining front and rear portions 3*a*, 3*b*, whereby the subsequent bending is facilitated. The rear portions 3*b* each form electrically conductive crimp connections with the end of the electrical lines 2.

In FIG. 1, the elongate contacts 3, which are initially still straight or have a straight longitudinal axis 23 (indicated by the dashed line), are introduced into the plug fabrication device 20 (along the vertical arrow) until the front portions 3*a* are applied against stops 4 of the positioning tool 14 brought into position. Here, the positioning tool 14 is movable within the plug fabrication device 20 (indicated schematically by the vertical double-headed arrow) so as to move from the working region into a standby position and vice versa.

The contacts 3 can be introduced into the plug fabrication device 20 by a movement of the cable 1, for example by hand, or by a transport arrangement provided specifically for this purpose.

The stops 4 are preferably formed as a stop sensor(s), that is to say they record the moment at which the contacts 3 are applied against them and therefore assume the correct position for further processing. The stop sensors cooperate with a control arrangement (not illustrated in greater detail), which, when the stop position of the contacts 3 has been reached, actuates a second holding arrangement 21.

The second holding arrangement 21 consists in the illustrated embodiment of two opposed actuatable clamp parts 5, which surround the introduced contacts 3, and a counter piece 6 that can be introduced between the contacts 3 (or between the clamps 5). Whereas the clamp parts 5 are movable in accordance with the horizontal double-headed arrows between an open and a clamping position, the counter piece 6 is movable in a direction transverse to the drawing plane in order to move into and out from the working region.

In a preferred embodiment, the clamp parts 5 are also displaceable similarly to the counter piece 6 or together with the counter piece 6 transversely with respect to the drawing plane. Both can thus be moved into and out from the working region before the folding tool is moved into the working region in order to close the wings (will be explained in greater detail further below).

As soon as the contacts 3 have reached the correct position, the clamps 5 surround the contacts in cooperation with the counter piece 6, whereby said contacts are fixed and held. The second holding arrangement 21 is formed here in such a way that it holds the contacts 3 so as to be oriented parallel to one another.

FIG. 2 then shows a subsequent working position of the plug fabrication device 20. In this position, a first holding arrangement 15 (not shown in FIG. 1) has already been moved into the working region, whereas the positioning tool 14 remains in a standby position. The holding arrangement 15 is formed as a gripper having two gripper jaws 15*a*, 15*b* movable towards one another. In the position in FIG. 2, the holding arrangement 15 is currently gripping a prefabricated plug housing part 7 and is holding it for the further processing process.

The plug housing part 7 comprises contact receptacles 17 for the cooperation with the contacts 3. In the present case, the receptacles are elongate receptacles adapted to the contour of the front contact portions 3*a*. To the side, the plug housing part 7 comprises wings 10, which have to be folded to fully close the housing.

The first holding arrangement 15 is then moved with the plug housing part 7 held thereby in the direction of the second holding arrangement 21 with the contacts 3 held thereby, such that the contacts 3 enter the contact receptacles 3 along their longitudinal axes, 23, which are still straight. Whereas the right-hand contact 3 enters a contact receptacle 17 fully, the left-hand contact 3 only reaches into the corresponding contact receptacle 17 as far as a certain depth (FIG. 3). This difference is length is compensated for by the subsequent bending of the contacts 3 (FIG. 4). The pivot axis 22 is the axis about which the first holding arrangement 15 is pivoted relative to the second holding arrangement 21 in order to bend the contacts 3. The pivoting motion is indicated by the curved arrow.

In the working position in FIG. 4, the first holding arrangement 15 has already been pivoted relative to the second holding arrangement 21, whereby the longitudinal axis 23 of the contacts 3 is bent in the region between their front portions 3*a* and their rear portions 3*b*. The illustrated example shows the fabrication of a 90° plug, in which the front portions 3*a* are thus inclined compared to the rear portions 3*b* by substantially 90°. In principle however, other angles are also possible as required.

In the illustrated example, the second holding arrangement 21 remains stationary during the relative pivoting motion, whereas the first holding arrangement 15 rotates about a pivot axis 22. Of course, it is also possible for the first holding arrangement 15 to remain stationary with the plug housing part 7 held thereby and for the second holding arrangement 21 to be moved. It is also possible for the pivoting motion to be superimposed by a movement in translation. The expression "pivoting" is to be understood here in the broadest sense.

In the illustrated example, a bending axis 16 is defined by the bending line, that is to say the bent contour of the contacts 3, and passes through the midpoint of the bent portion. The bending process can be defined by dies introduced into the working region, whereby a reproducible shaping of the contacts 3 is provided. The effect of dies 8 and further supports 9 will be explained on the basis of FIGS. 11 to 14. Instead of a bending axis 16, a slightly broader bending axis region, for example with a number of bend axes, can also be produced with corresponding design of the dies 8, for example in the case of a portion bent not exactly in a circular manner.

Figure 16:
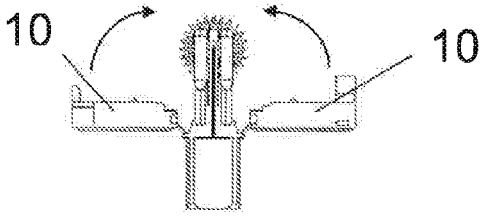

In FIG. 4, a folding tool 13 of the plug fabrication device 20 has already been brought into a standby position so as to adopt a working position in FIG. 5. The folding tool 13 comprises at least one driver 12 pivotable about a pivot axis 11. Here, the folding tool 13 is positioned in such a way that the pivotable driver 12 reaches the height of the wing 10. By pivoting the driver 12, the wing 10 is entrained and folded, whereby a finished housing 18 is formed (FIG. 6). The process for folding the two symmetrical wings 10 is also illustrated in FIG. 16.

The finished plug 18 can be seen in FIG. 6. Whereas the rear portions 3*b* represent crimp connections to the electrical lines 2 of a cable 1, the front portions 3*a* form the contacts of the finished plug 18. The plug housing part 7, from which the finished plug housing 19 is created, is produced fully in the present example from electrically non-conductive material, preferably plastic. The front portions form the plug contacts accessible from the outside, in particular in the form of sleeves (female plug contacts) or also in the form of pins (male plug contacts).

In the illustrated example, two contacts 3 in the plug housing 19 can be seen, however more than two contacts 3 can of course also be joined together to form a plug 18.

For the sake of clarity, the individual holding arrangements 15, 21 and auxiliary tools 13, 14 are illustrated in FIGS. 1 to 5 without the carriers holding and displacing them. The carriers can be mounted for example so as to be displaceable along guides and/or pivotable about pivot axes.

The individual processing steps will now be described in detail on the basis of FIGS. 7 to 16, wherein, for the sake of clarity, components of the plug fabrication device 20 are omitted.

In a first step (not illustrated), the plug housing part 7 is fitted into the first holding arrangement 15.

In a second step, the contacts 3, which are already crimped to the lines 2 or strands of a cable 1, are moved in the direction of a positioning tool (FIG. 7) and are each interrogated individually by a stop 4 formed as a stop sensor in order to ascertain whether they have reached their end position.

Figure 8:
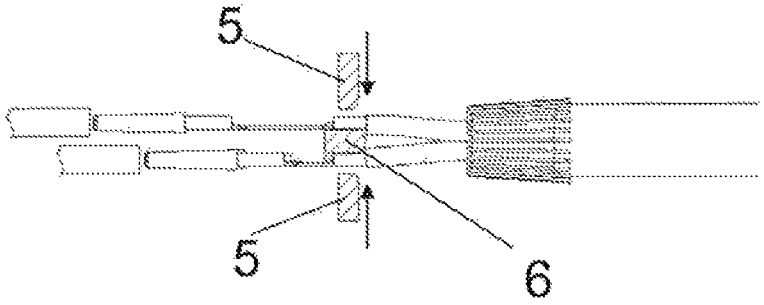
Figure 9:
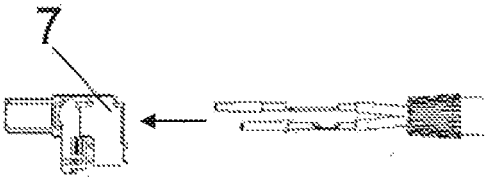
Figure 10:
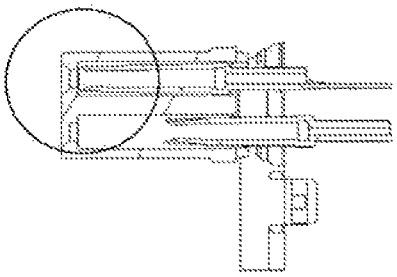
Figure 11:
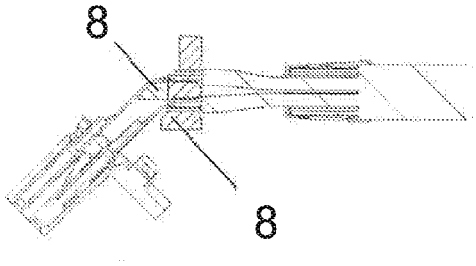
Figure 12:
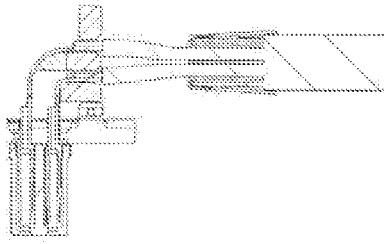

A control arrangement (not illustrated) connected to the sensors controls the clamp parts 5, which press the contacts 3 against a fixed body in the form of a counter piece 6 and thus secure them against rotation and slipping (FIG. 8).

The plug housing part 7 is then slid onto the contacts 3 (for example four in number) (FIG. 9) Here, only the long contact 3 is initially introduced fully into the contact receptacle 17 (FIG. 10), whereas the short contact 3 protrudes only in part into the corresponding contact receptacle 17.

With the aid of the plug housing part 7, the contacts 3 are bent by a predefined angle, preferably by 90°. In so doing, the short contact 3 slides into its end position in the corresponding contact receptacle (FIGS. 11 to 14).

Dies 8 introduced into the bending region support the contacts 3 during the bending process, such that they retain a defined bend radius or bend radii.

Figure 13:
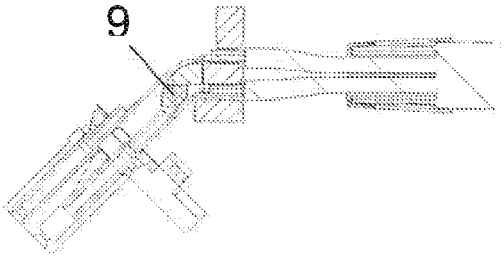
Figure 14:
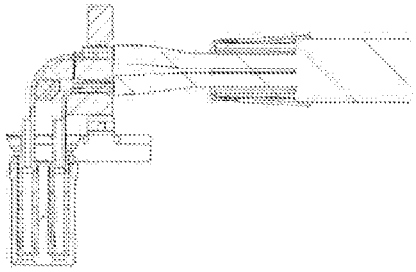

The long contact 3 may optionally receive an additional support 9, which is inserted at an angle of approximately 45° for example (FIGS. 13 and 14). A more exact radius is thus produced over the entire length of the bend.

Figure 15:
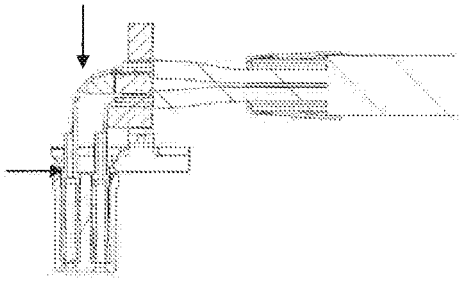

Once the contacts have been bent, the outer, long contacts 3 are pressed into the end position and are then fixed on the collar (FIG. 15). To this end, narrow slides are used. These are indicated schematically by the arrows, which simultaneously also show the direction of movement thereof. The slides can sit on a single tool or can be integrated on a tool already described beforehand.

One or more first slides (vertical arrow), which runs/run axially with respect to the front portions 3*a* of the contacts 3, has/have a contour adapted to the bend radius. The two outer contacts are pressed by means of the aforesaid slide(s) into the intended end position in the plug housing part 7.

A second slide (horizontal arrow) then moves axially with respect to the rear portions 3*b* with small lugs over the collar of the contact 3, such that it can no longer move axially from the plug housing part 7 towards the front portions 3*a*. The first slide(s) now travels/travel out of engagement again and releases/release the working region for the pivoting of the (pivot) wings 10.

The second slide is formed such that it can remain in engagement during the closure process. The contact therefore cannot jump out. For this purpose, the plug housing part 7 may comprise corresponding recesses for the lugs of the slides.

According to FIG. 16, the wings 10 protruding from either side of the plug housing part 7 are closed around the bent contacts 3 (four in the present case), whereby a finished, closed housing 19 is produced (FIG. 6) Here, the bent portions of the contacts are located inside the housing 19.

As an alternative to the wings 10 already formed integrally on the plug housing part 7, separate covers could be attached to the plug housing part 7 in a subsequent method step and supplement the plug housing part 7 so as to form a complete, closed plug housing 18.

The finished product, that is to say a cable with a plug fabricated thereon, can then be removed from the holding arrangements.

The invention is not limited to the described embodiments. Additional auxiliary tools, such as a centring arrangement for centring the contacts with respect to the plug housing part, a fixing arrangement for fixing the contacts in an end position in the contact receptacles of the plug housing part and/or further auxiliary tools, may thus be provided.

LIST OF REFERENCE SIGNS

1 cable
2 line
3 elongate contact
3*a* front portion of the contact 3
3*b* rear portion of the contact 3
4 stop
5 clamp part
6 counter piece
7 plug housing part
8 die
9 support
10 wing of the plug housing part 7
11 pivot axis of the driver 12
12 driver
13 folding tool
14 positioning tool
15 first holding arrangement
16 bending axis
17 contact receptacle
18 plug
19 plug housing
20 plug production device
21 second holding arrangement
22 pivot axis
23 longitudinal axis of the contact 3

The invention claimed is:

1. A device (20) for fabricating a plug (18) formed from a plug housing (19) and elongate contacts (3), the elongate contacts (3) inside the formed plug (18) having a bent longitudinal axis (23), said device comprising:

a first holding arrangement (15) for holding a plug housing part (7) having contact receptacles (17), into which front portions (3*a*) of the elongate contacts (3) are introduced;

a second holding arrangement (21) for holding rear portions (3*b*) of the elongate contacts (3);

at least one die (8), which is movable into a region between the front portions (3*a*) and the rear portions (3*b*) of the elongate contacts (3); and a folding tool (13) for engaging a wing (10) of the plug housing part (7), wherein the first holding arrangement (15) and the second holding arrangement (21) are pivotable relative to one another, and the elongate contacts (3) are biased against the at least one die (8), such that the longitudinal axis (23) of the elongate contacts (3) bends in the region between the front portions (3*a*) and their rear portions (3*b*) of the elongate contacts (3), and the folding tool (13) operates to engage the wing (10) of the plug housing part (7), after the pivoting of the first and second holding arrangements (15, 21), to fold the wing (10) in order to form a closed plug housing (19).

2. The device according to claim 1, wherein the first holding arrangement (15) and the second holding arrangement (21) are movable relatively towards one another in order to introduce front portions (3*a*) of the elongate contacts (3) into the contact receptacles (17) of the plug housing part (7), the first holding arrangement (15) comprises a gripper, which can adopt an open position and a gripping position, and/or the second holding arrangement (21) comprises clamp parts (5) movable relative to one another.

3. The device according to claim 1, further comprising a positioning tool (14) movable relative to the second holding arrangement (21) in order to position the elongate contacts (3) in the second holding arrangement (21), the positioning tool preferably comprising stops (4) for the front portions (3*a*) of the elongate contacts (3), and the stops (4) preferably being formed as stop sensors.

4. The device according to claim 3, wherein the at least one of the stops (4) of the positioning tool (14) is set back relative others of the stops (4) of the positioning tool (14).

* * * * *